United States Patent [19]

Trowbridge

[11] Patent Number: 5,052,853

[45] Date of Patent: Oct. 1, 1991

[54] APPARATUS FOR MAINTENANCE OF A GRAVEL ROAD

[75] Inventor: Anthony V. Trowbridge, Transvaal, South Africa

[73] Assignee: Matador Industries (Proprietary) Limited, Transvaal, South Africa

[21] Appl. No.: 613,967

[22] Filed: Nov. 13, 1990

Related U.S. Application Data

[63] Continuation of Ser. No. 380,102, Jul. 14, 1989, abandoned.

[30] Foreign Application Priority Data

Jul. 15, 1988 [ZA] South Africa ..... 88/5132

[51] Int. Cl.[5] ..... E01C 23/08; E01C 23/12

[52] U.S. Cl. ..... 404/92; 404/118

[58] Field of Search ..... 404/92, 90, 75, 118

[56] References Cited

U.S. PATENT DOCUMENTS

| | | | |
|---|---|---|---|
| 918,993 | 4/1909 | Gaines | 404/118 |
| 1,068,155 | 7/1913 | Mosher | 404/118 |
| 1,802,087 | 4/1931 | McConnaughay | 404/92 |
| 1,862,232 | 6/1932 | McLeod | 404/92 |
| 2,031,628 | 2/1936 | Aherne | 404/92 |
| 3,488,963 | 1/1970 | Hnot | 404/92 |
| 3,936,209 | 2/1976 | Krage | 404/118 |

FOREIGN PATENT DOCUMENTS

| | | | |
|---|---|---|---|
| 2234424 | 1/1975 | France | 404/118 |

*Primary Examiner*—Ramon S. Britts
*Assistant Examiner*—Gay Ann Spahn
*Attorney, Agent, or Firm*—Ladas & Parry

[57] ABSTRACT

Apparatus for smoothing a gravel road comprises a mat which incorporates a series of wave-form members, typically of flexible material such as rubber. The mat is towed over the road surface with the result that the crests of the wave-form members dig into corrugations in the surface and disturb the gravel. The disturbed gravel can flow upwardly through the spaces between the wave-form members.

9 Claims, 2 Drawing Sheets

APPARATUS FOR MAINTENANCE OF A GRAVEL ROAD

This is a continuation of copending application Ser. No. 380,102 filed on July 14, 1989, abandoned Dec. 27, 1990.

BACKGROUND OF THE INVENTION

This invention relates to road maintenance and particularly to the maintenance of gravel roads.

A major problem with gravel roads is their tendency to build up corrugations after prolonged use. To date, no real scientific explanation for the formation of corrugations has been proposed, nor has any method of preventing corrugation build-up been successful. At present, corrugations on the surface of a gravel road are dealt with by grading the road surface periodically and this is an expensive and time-consuming operation.

SUMMARY OF THE INVENTION

According to the present invention, apparatus for smoothing the surface of a gravel road comprises a mat which can be towed over the road surface behind a towing vehicle, the mat comprising a plurality of wave-form members arranged side-by-side and extending transversely of the towing direction so as to sweep over the road surface during towing, the wave-form members defining spaces between them through which disturbed gravel can flow.

In a preferred form of the invention, the wave-form members are flexible and the mat also includes one or more blades arranged transversely to the towing direction and arranged to engage the road surface and perform a skimming action thereon.

The invention also provides a method of smoothing the surface of a gravel road, the method comprising towing a mat of the kind specified above over the road surface.

BRIEF DESCRIPTION OF THE DRAWINGS

The invention will now be described in more detail, by way of example only, with reference to the accompanying drawings in which.

DESCRIPTION OF A PREFERRED EMBODIMENT

Figure 1:
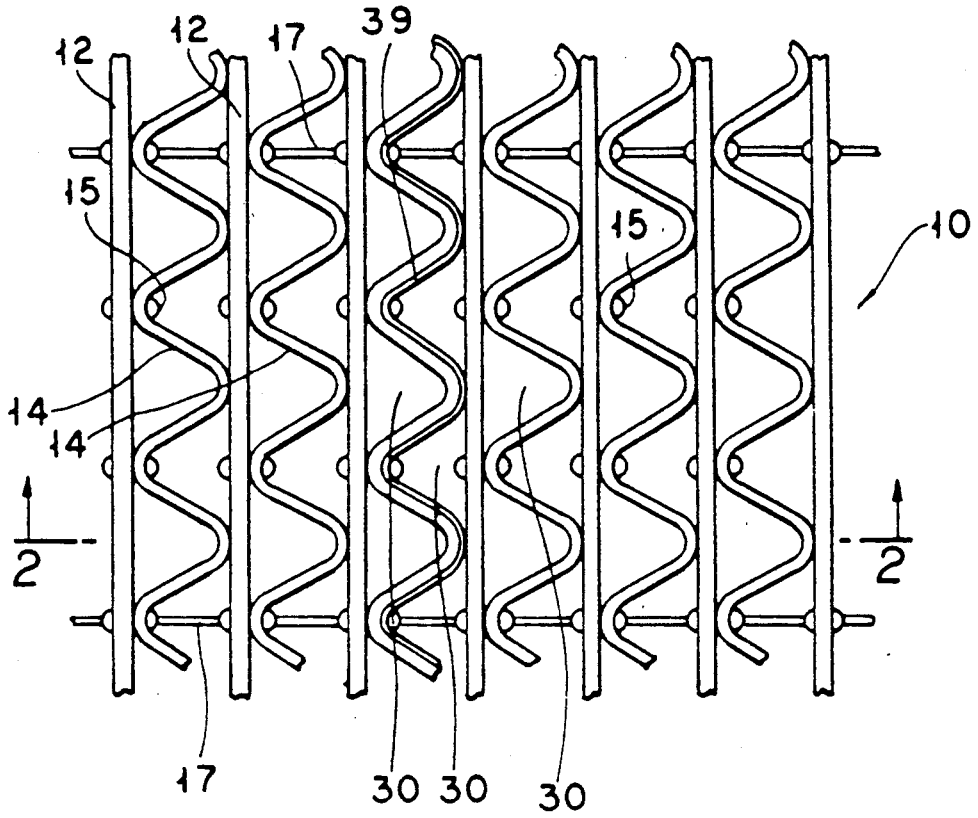
FIG. 1 shows a partial plan view of a mat forming part of an apparatus according to the invention.
Figure 2:
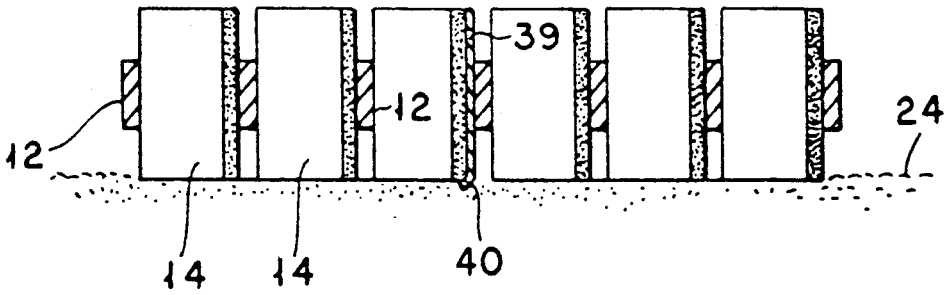
FIG. 2 shows a partial cross-section at the line 2—2 in FIG. 1.

In FIG. 1 a mat 10 has a series of rigid metal strips 12 between which wave-form members 14 are arranged. The wave-form members 14 are secured to the strips 12 by means of rivets 15, and their lower edges extend below the strips as shown in FIG. 2. The mat assembly is held together by wires 17 located at intervals and passing through the rivets 15. The wave-form members are made of a robust rubber or plastics material and have a degree of inherent flexibility. In the illustrated embodiment the wave-form members have a sinusoidal shape.

Figure 3:
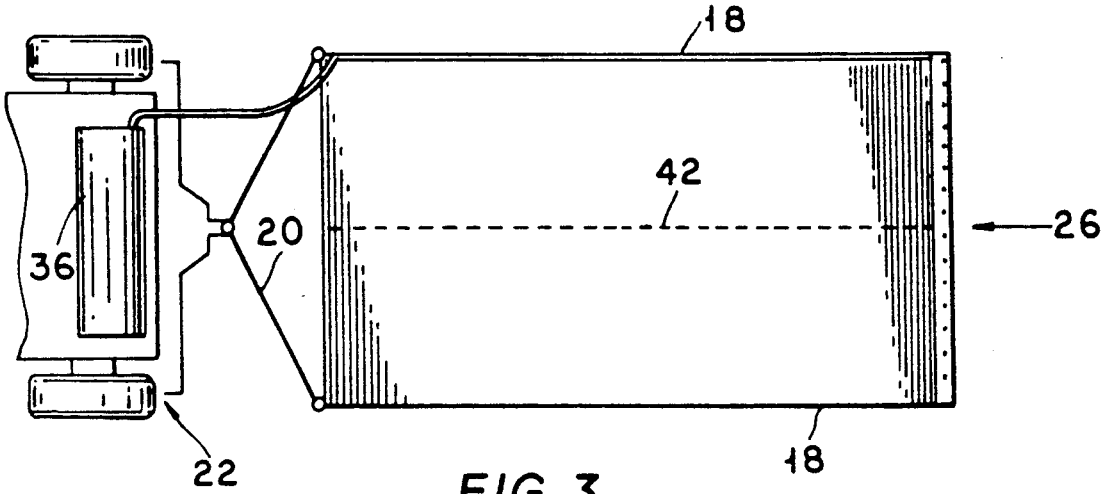
FIG. 3 shows a plan view of the mat in use.

In FIG. 3, the mat 10 is seen to have rigid side members 18 to which the ends of the rigid strips 12 are connected, the members 18 and strips 12 therefore forming a rigid frame for the wave-form members 14. In use, the ends of the leading strip 12 are connected by means of a cable 20 to the tow-hitch of a towing vehicle 22 with the mat 10 resting on a gravel road surface 24 which is to be smoothed.

Figure 5:
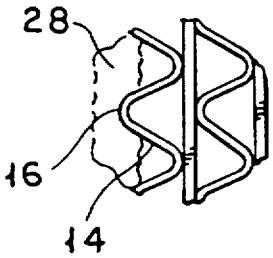
FIG. 5 shows an enlarged plan view of the wave-form members of the not shown in FIG. 3.

As the mat is towed in the direction of the arrow 26, the crests 16 of the wave-form members encounter any irregularities in the road surface 24 and have the tendency to smooth those irregularities out. This is illustrated in FIG. 5 which shows a transverse corrugation at 28 and the crests 16 of the leading member 14 "digging into" the corrugation. Gravel which is disturbed by the passage of the mat over the road surface is able to flow upwardly through the spaces 30 existing in the mat between the wave-form members 14. The loose material can then flow rearwardly over the mat as more material flows upwardly through it. The result after passage of the mat is that the loose material is spread out behind the mat on the road surface.

Clearly it is important that the mat has a relatively high mass so that it does not merely pass over the road surface irregularities, but disturbs them. If, in a particular application, where there are well developed or hard corrugations in the road surface, it transpires that the mass of the mat is insufficient to perform an adequate smoothing operation, loose weights 32 can be placed on the upper surface of the mat to hold it down.

Figure 4:
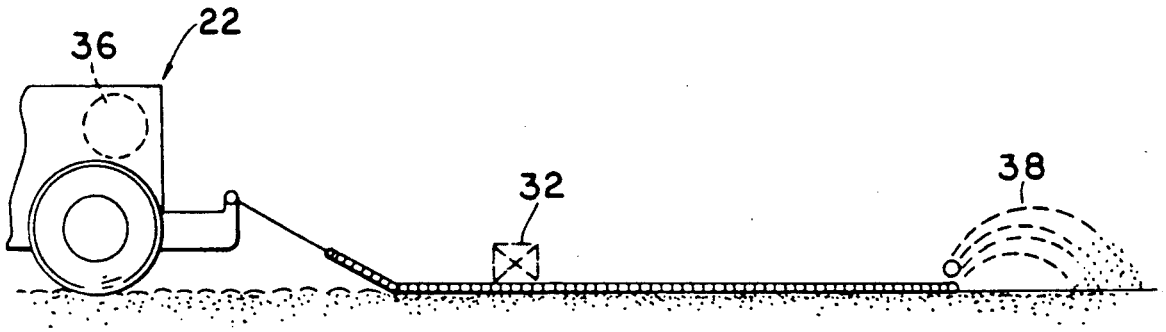
FIG. 4 shows a side elevation of the mat in use.
Figure 3:
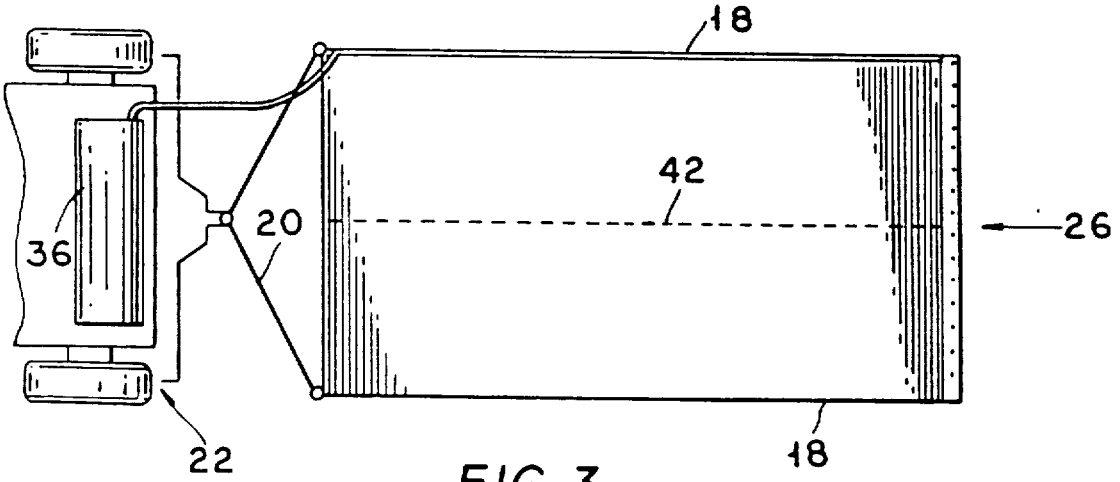
Figure 4:
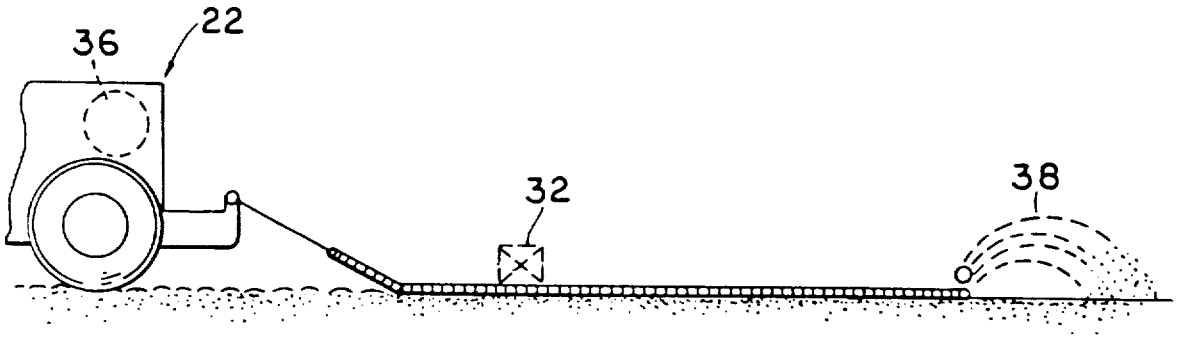

Referring to FIGS. 3 and 4 it will be seen that the trailing end of the mat carries a perforated pipe which is supplied with water stored in a tank 36 on the towing vehicle. The perforations in the pipe are designed to form a water spray 38 behind the mat. This spray dampens the loose material which has been deposited behind the mat and prevents excessive dust build-up.

FIGS. 1 and 2 show how a rigid steel blade 39 can be incorporated in the mat, the blade having an inclined cutting edge 40 extending to the same level as the bottom edges of the members 14. If a particularly hard irregularity in the road surface is encountered, the blade will dig into it to loosen it even if the flexible members 14 are unable to do so. In the illustrated case, the blade has a wave-form shape, but in other cases it can be straight.

In the case of a narrow road, it is proposed to make the mat wide enough to sweep over the full width in a single pass. Since most gravel roads are cambered, it will be necessary in this case to have a longitudinal hinge 42 extending in the towing direction to enable the mat to take up the shape of the road surface.

I claim:

1. Apparatus for maintaining the surface of a gravel road by reducing the tendency of the road surface to develop transverse corrugations, the apparatus comprising a mat which can be dragged over the road surface by a towing vehicle, the mat comprising a plurality of flat elongated resiliently flexible members which extend lengthwise in a direction transverse to the dragging direction, said resiliently flexible members being arranged on edge relative to the road surface to form a wave form shape when viewed in a direction transverse to the road surface, said resiliently flexible members also being spaced apart one behind the other in the dragging direction to form spaces therebetween so that in use the gravel from the road surface, by the action of the flexible members as the mat is dragged over the road surface, is caused to flow upwardly in the spaces and over said flexible members to be spread out behind the mat after passage of the mat.

2. Apparatus according to claim 1 wherein the flexible members are made of rubber or plastics material.

3. Apparatus according to claim 1 wherein the mat comprises one or more blades arranged transversely to the dragging direction and arranged to engage the road surface and perform a skimming action thereon.

4. Apparatus according to claim 1 wherein the waveforms have a sinusoidal shape.

5. Apparatus according to claim 1 wherein the mat comprises rigid metal strips which are disposed between the flexible members and to which the flexible members are secured.

6. Apparatus according to claim 5 wherein the flexible members are secured to the metal strips by means of rivets and wherein spaced wires pass in the dragging direction through the flexible members.

7. Apparatus according to claim 6 wherein the ends of the metal strips are connected to rigid side members forming sides for the mat.

8. Apparatus according to claim 1 wherein the mat carries a water spray device for spraying water onto the road surface after passage of the mat.

9. The apparatus according to claim 1, wherein the mat further comprises at least one rigid elongated blade arranged on edge relative to the road surface and positioned adjacent to at least one resiliently flexible member, said blade extending transversely relative to the dragging direction for performing a skimming action on the road surface during passage of the mat.

* * * * *

UNITED STATES PATENT AND TRADEMARK OFFICE

CERTIFICATE OF CORRECTION

PATENT NO. : 5,052,853

DATED : OCTOBER 1, 1991

INVENTOR(S) : Anthony V. TROWBRIDGE

It is certified that error appears in the above-identified patent and that said Letters Patent is hereby corrected as shown below:

Sheet 2 of 2 of the drawings, should be deleted.

The sheet of drawing, consisting of figures 3-5, should be added as shown on the attached sheet.

Signed and Sealed this

Twenty-eighth Day of June, 1994

Bruce Lehman

*Attest:*

BRUCE LEHMAN

*Attesting Officer*

*Commissioner of Patents and Trademarks*